US008715427B2

(12) United States Patent
Vandeputte et al.

(10) Patent No.: US 8,715,427 B2
(45) Date of Patent: May 6, 2014

(54) ULTRA HIGH STRENGTH STEEL COMPOSITION, THE PROCESS OF PRODUCTION OF AN ULTRA HIGH STRENGTH STEEL PRODUCT AND THE PRODUCT OBTAINED

(75) Inventors: Sven Vandeputte, Ruisbroek (BE); Christophe Mesplont, Lambersart (FR); Sigrid Jacobs, Gent (BE)

(73) Assignee: ArcelorMittal France SA, St Denis (FR)

( * ) Notice: Subject to any disclaimer, the term of this patent is extended or adjusted under 35 U.S.C. 154(b) by 1270 days.

(21) Appl. No.: 10/487,302

(22) PCT Filed: Aug. 28, 2002

(86) PCT No.: PCT/BE02/00139

§ 371 (c)(1),
(2), (4) Date: Jul. 16, 2004

(87) PCT Pub. No.: WO03/018858

PCT Pub. Date: Mar. 6, 2003

(65) Prior Publication Data

US 2004/0238080 A1 Dec. 2, 2004

(30) Foreign Application Priority Data

Aug. 29, 2001 (EP) ..... 01870186

(51) Int. Cl.

| | |
|---|---|
| ***C22C 38/00*** | (2006.01) |
| ***C21D 8/02*** | (2006.01) |
| ***C22C 38/12*** | (2006.01) |
| ***C23C 2/06*** | (2006.01) |

(52) U.S. Cl.
USPC ..... 148/320; 148/579; 148/533; 420/121; 420/124; 420/128

(58) Field of Classification Search
CPC ..... C22C 38/04; C22C 38/12; C21D 1/20
USPC ..... 148/320, 579, 533; 420/121, 124, 128
See application file for complete search history.

(56) References Cited

U.S. PATENT DOCUMENTS 3,251,679 A * 5/1966 Graef ..... 75/545
4,388,122 A * 6/1983 Sudo et al. ..... 148/602

(Continued)

FOREIGN PATENT DOCUMENTS

DE 197 10 125 9/1998
EP 0 019 193 11/1980

(Continued)

OTHER PUBLICATIONS

ASM International, Materials Park, Ohio, Properties and Selection: Irons, Steels, and High Performance Alloys, "Sheet Formability of Steels", Mar. 1990, pp. 573-580.*

(Continued)

*Primary Examiner* — Jessee Roe
(74) *Attorney, Agent, or Firm* — Merchant & Gould P.C.

(57) ABSTRACT

The present invention is related to a steel composition, a process for producing a steel product having said composition, and said steel product itself. According to the invention, a cold-rolled, possibly hot dip galvanized steel sheet is produced with thicknesses lower than 1 mm, and tensile strengths between 800 MPa and 1600 MPa, while the A80 elongation is between 5 and 17%, depending on the process parameters. The composition is such that these high strength levels may be obtained, while maintaining good formability and optimal coating quality after galvanising. The invention is equally related to a hot rolled product of the same composition, with higher thickness (typically about 2 mm) and excellent coating quality after galvanising.

31 Claims, 2 Drawing Sheets

(56) References Cited

U.S. PATENT DOCUMENTS

| | | | | |
|---|---|---|---|---|
| 4,640,872 | A * | 2/1987 | Irie et al. | 428/659 |
| 4,790,885 | A * | 12/1988 | Imagumbai et al. | 148/505 |
| 5,332,453 | A * | 7/1994 | Okada et al. | 148/320 |
| 5,470,529 | A | 11/1995 | Nomura et al. | |
| 6,364,968 | B1 * | 4/2002 | Yasuhara et al. | 148/320 |
| 6,589,369 | B2 | 7/2003 | Yokoi et al. | |
| 6,623,573 | B2 * | 9/2003 | Inoue et al. | 148/602 |
| 6,632,296 | B2 | 10/2003 | Yoshinaga et al. | |

FOREIGN PATENT DOCUMENTS

| | | | |
|---|---|---|---|
| EP | 0 707 087 | A1 | 4/1995 |
| EP | 0 796 928 | A1 | 6/1996 |
| EP | 0 922 782 | A1 | 6/1998 |
| EP | 0 861 915 | | 9/1998 |
| EP | 1 096 029 | A1 | 4/2000 |
| EP | 1 028 167 | A2 | 8/2000 |
| EP | 1 028 167 | A3 | 8/2000 |
| EP | 1 154 028 | A1 | 5/2001 |
| EP | 1 170 391 | A1 | 6/2001 |
| EP | 1 154 028 | A1 | 11/2001 |
| JP | 03-207814 | | 9/1991 |
| JP | 3-207814 | | 9/1991 |
| JP | 03/207814 | | 9/1991 |
| JP | 5-65541 | | 3/1993 |
| JP | 05/265433 | | 11/1993 |
| JP | 7-118792 | | 5/1995 |
| JP | 7-252592 | | 10/1995 |
| JP | 09-067645 | | 3/1997 |
| JP | 9-176741 | | 7/1997 |
| JP | 09-263884 | | 10/1997 |
| JP | 10-219387 | | 8/1998 |
| JP | 10-237547 | * | 9/1998 |
| JP | 10-280087 | | 10/1998 |
| JP | 11-100635 | | 4/1999 |
| JP | 11-310828 | | 11/1999 |
| JP | 11-315328 | | 11/1999 |
| JP | 2000-080440 | | 3/2000 |
| JP | 2000-109951 | | 4/2000 |
| JP | 2000-160278 | | 6/2000 |
| JP | 2003-234153 | | 8/2000 |
| JP | 2001-11574 | | 1/2001 |
| JP | 2001-081533 | | 3/2001 |
| JP | 2001-303226 | | 10/2001 |
| JP | 2001/355044 | | 12/2001 |
| WO | 98-40522 | | 9/1998 |
| WO | WO 99/05336 | | 2/1999 |
| WO | WO 01/81640 | A1 | 11/2001 |
| WO | WO 01/94655 | A1 | 12/2001 |

OTHER PUBLICATIONS

ASM International, Materials Park, Ohio, Properties and Selection: Irons, Steels, and High Performance Alloys, "Classifcation and Designation of Carbon and Low Alloy Steels", Mar. 1990, vol. 1, pp. 144-147.*

ASM International, Materials Park, Ohio, Properties and Selection: Irons, Steels, and High Performance Alloys, "Sheet Formability of Steels", Mar. 1990, vol. 1, pp. 573-580.*

Katsumata et al. "Development of High Strength and High Toughness Low Carbon-Low Alloy Steel for Hot Forged Parts" Kobelco Technology Review, 1991, p. 29-32.

Cahn et al. "Materials Science and TEchnology, vol. 7, Constitution and Properties of Steels" 1992, VCH, Weinheim, New York, XP002190314 pp. 207-208.

"Annual Book of ASTM Standards, Iron and Steel Products, vol. 01.04" 2001, ASTM, USA XP002190315, pp. 312-313.

Pichler et al., "Aspects of the Production of Dual Phase Multiphase Steel Strips," *41st MWSP Conf. Proc., ISS* (1999) XXXVII: 37-60.

Mesplont et al., "Development of High-Strength Bainitic Steels for Automotive Applications," *41st MWSP Conf. Proc., ISS* (1999) XXXVII: 515-524.

Office Action for co-pending U.S. Appl. No. 10/539,758 mailed Apr. 17, 2008.

Office Action for co-pending U.S. Appl. No. 10/539,758 mailed Nov. 3, 2008.

Opposition Document for corresponding European Patent EP1423547—Feb. 12, 2009—Communication inviting the parties to file observations.

Opposition Document for corresponding European Patent EP1423547—Feb. 12, 2009—Internal form—Opposition/addressees.

Opposition Document for corresponding European Patent EP1423547—Feb. 12, 2009—Annex to the communication—opposition.

Opposition Document for corresponding European Patent EP1423547—Feb. 5, 2009—Communication inviting the parties to file observations.

Opposition Document for corresponding European Patent EP1423547—May 7, 2008—Brief communication—Opposition proceedings.

Opposition Document for corresponding European Patent EP1423547—Apr. 11, 2008—Brief communication—Opposition proceedings.

Opposition Document for corresponding European Patent EP1423547—Dec. 13, 2007—Grant of extension of time limit (opposition procedure).

Opposition Document for corresponding European Patent EP1423547—Dec. 13, 2007—Brief communication—Opposition proceedings.

Opposition Document for corresponding European Patent EP1423547—Oct. 29, 2007—Notice of further oppositions to opponent(s).

Opposition Document for corresponding European Patent EP1423547—Oct. 29, 2007—Communication of a notice of opposition and request to file observations.

Opposition Document for corresponding European Patent EP1423547—Oct. 2, 2007 Brief communication—Opposition proceedings.

Opposition Document for corresponding European Patent EP1423547—Sep. 28, 2007—Communication of a notice of opposition—first information to patent proprietor.

Opposition Document for corresponding European Patent EP1423547—Sep. 24, 2007 Filing of a new opposition.

Opposition Document for corresponding European Patent EP1423547—Sep. 20, 2007—Fax filed during the opposition procedure.

Pichler et al., "Correlation between thermal treatment, retained austenite stability and mechanical properties of low-alloyed TRIP steels," *Int. Conf. on TRIP-Aided High Strength Ferrous Alloys* Ghent, Belgium, Jun. 19-21, 2002; p. 171-179.

Barbé et al., "Effect of phosphorus on the properties of a cold rolled and intercritically annealed TRIP-aided steel," *Int. Conf. on TRIP-Aided High Strength Ferrous Alloys* Ghent, Belgium, Jun. 19-21, 2002; p. 171-179.

Yakubovsky et al., "Stress-strain behaviour and bake hardening of TRIP and TRIP-aided multiphase steels," *Int. Conf. on TRIP-Aided High Strength Ferrous Alloys* Ghent, Belgium, Jun. 19-21, 2002; p. 171-179.

Papaefthymiou et al., "Microstructure development and mechanical behaviour of Al-containing TRIP-steels," *Int. Conf on TRIP-Aided High Strength Ferrous Alloys* Ghent, Belgium, Jun. 19-21, 2002; p. 171-179.

Extract (pp. 161/162) from "Principes de base des traitements thermiques, thermomécaniques et thermochimiques des aciers", published 1992, PYC Editions, authors: A. Constant, G. Henry, J.C. Charbonnier; translation of relevant portion from the start of paragraph 2.a on p. 161 up to and including the first six lines on p. 162; and translator's declaration.

Furuya et al., "Effects of carbon and phosphorus addition on the fatigue properties of ultrafine-grained steels." 2005, *Scripta Materialia*, 52:1163-1167.

(56) References Cited

OTHER PUBLICATIONS

Hughes et al., 1998, "Determination of tract amounts of phosphorus in high purity iron by electrolthermal vaporization inductively coupled plasma mass spectrometry." *Spectrochimica Acta Part B*, 53:1079-1085.
Association of Iron and Steel Engineers, *The Making, Shaping and Treating of Steel*, $10^{th}$ edition, Pittsburgh: Herbick & Held, 1985, pp. 1083.
Bhadeshia, "Neural Networks in Materials Science", *ISIJ International*, vol. 39, No. 10, 1999, pp. 966-979.
Bramfitt et al., "Structure/Property Relationships in Irons and Steels", *Metals Handbook Desk Edition, Second Edicition*, 1998, pp. 153-173.
Cota et al., "Simulation of the controlled rolling and accelerated cooling of a bainitic steel using torsion testing", *Journal of Materials Processing Technology* 100, 2000, pp. 156-162.
Hai-long et al., "Bainite Transformation under Continuour Cooling of Nb-microalloyed Steel", *Journal of Iron and Steel Research International*, vol. 13, Issue 3, 2006, pp. 36-39.
Lee, "Empirical formula of isothermal bainite start temperature of steels", *Journal of Materials Science Letters*, vol. 21, 2002, pp. 1253-1255.
Mesplont et al., "Hot-Rolled Bainitic Steels", *Thermomechanical Processing of Steels*, 2000, pp. 495-504.
Letter to European Patent Office dated Feb. 19, 2013 re: Opposition by Tata Steel IJmuiden BV of patent No. EP1423547 in the name of Arcelor France—Appeal case T1790/12.

* cited by examiner

ULTRA HIGH STRENGTH STEEL COMPOSITION, THE PROCESS OF PRODUCTION OF AN ULTRA HIGH STRENGTH STEEL PRODUCT AND THE PRODUCT OBTAINED

FIELD OF THE INVENTION

The present invention is related to an ultra high strength steel composition, to the process of production of an ultra high strength steel product, and to the end product of said process.

STATE OF THE ART

In the automotive industry there is a need for weight reduction, which implies the use of higher strength materials in order to be able to decrease the thickness of the parts without giving up safety and functional requirements. Ultra high strength steel (UHSS) sheet products having a good formability can provide the solution for this problem.

Several documents are describing such UHSS products. More particularly, document DE19710125 describes a method for producing a highly resistant (higher than 900 MPa) ductile steel strip with (in mass %) 0.1 to 0.2% C, 0.3 to 0.6% Si, 1.5 to 2.0% Mn, max 0.08% P, 0.3 to 0.8% Cr, up to 0.4% Mo, up to 0.2% Ti and/or Zr, up to 0.08% Nb. The material is produced as hot rolled strip. However, a drawback of this process is that for small thicknesses (e.g. smaller than 2 mm), the rolling forces drastically increase, which poses a limit to the possible dimensions that can be produced. The reason for this limit is the very high strength of this material not only on the end product but also at the temperatures in the finishing train of the hot rolling mill. Also the high Si-content is well known to provoke problems as to surface quality because of the presence of Si-oxides which after pickling create a surface with irregular and very high roughness. Moreover, in view of corrosion protection, hot dip galvanising of such a high Si-containing substrate in general leads to insufficient surface appearance or automotive applications, with moreover a high risk on the presence of bare spots on the surface.

Document JP09176741 describes the production of a high toughness hot rolled steel strip excellent in homogeneity and fatigue characteristics. The steel has a composition containing (in mass %), <0.03% C, <0.1% Al, 0.7 to 2.0% Cu, 0.005 to 0.2% Ti, 0.0003 to 0.0050% B and <0.0050% N. The hot rolled product has a structure in which the bainitic volume % is higher than 95% and the martensitic volume % is <2%. Drawbacks of this invention are beside the limited thicknesses that can be produced on a hot strip mill as explained above also the use of a substantial amount of Cu as alloying element. This element is only used for particular products and is generally not wanted in compositions used for example in deep drawing steels, structural steels and classical high strength steels for automotive applications. Thus, the presence of Cu makes scrap logistics and management in the steelmaking plant much more difficult if the majority of the product range contains grades where Cu has to be limited to a low impurity level. Moreover, copper is known to largely deteriorate the toughness of the heat-affected zone after welding and thus impairs the weldability. It is also often associated with problems of hot shortness.

Document EP0019193 describes the method of fabricating a dual phase steel containing mostly fine-grained ferrite with grains of martensite dispersed therein. The composition comprises 0.05-0.2% C, 0.5-2.0% Si, 0.5-1.5% Mn, 0-1.5% Cr, 0-0.15% V, 0-0.15% Mo, 0-0.04% Ti, 0-0.02% Nb. Production of said steel is by maintaining the temperature of the coiled hot rolled steel strip within the range of 800-650° C. for a time period of more than one minute, uncoiling the steel strip and cooling the steel strip to a temperature below 450° C. at a rate exceeding 10° C./s. It is described that by changing the amount of martensite from 5 to 25% , the tensile strength can be varied between 400 and 1400 MPa and the elongation between 40 and 10% . The drawbacks are again that only hot rolled products are considered as well as the high Si-content which poses problems for hot dip galvanising.

Document EP861915 describes a high toughness high tensile strength steel and the method for manufacturing it. The tensile strength is not less than 900 MPa, and the composition consists of (in mass % ) 0.02-0.1% C, Si<0.6%, Mn 0.2-2.5%, 1.2<Ni<2.5%, 0.01-0.1% Nb, 0.005-0.03% Ti, 0.001-0.006% N, 0-0.6% Cu, 0-0.8% Cr, 0-0.6% Mo, 0-0.1% V. Also addition of boron is considered. The microstructure of the steel may be a mixed structure of martensite (M) and lower bainite (LB) occupying at least 90 vol. % in the microstructure, LB occupying at least 2 vol. % in the mixed structure, and the aspect ratio of prior austenite grains is not less than 3. The production of said steel consists in heating a steel slab to a temperature of 1000° C. to 1250° C.; rolling the steel slab into a steel plate such that the accumulated reduction ratio of austenite at the non-recrystallisation temperature zone becomes not less than 50%; terminating the rolling at a temperature above the Ar3 point; and cooling the steel plate from the temperature above the Ar3 point to a temperature of not greater than 500° C. at a cooling rate of 10° C./sec to 45° C./sec as measured at the centre in the thickness direction of the steel plate. Drawbacks of this invention are the addition of a substantial amount of Ni which is in classical carbon steelmaking plants far from frequently used (posing the same scrap management problems as Cu in the previous document cited) as well as the limitation to hot rolling.

Document W09905336 describes an ultra high strength weldable boron-containing steel with superior toughness. The tensile strength is at least 900 MPa and the microstructure is comprising predominantly fine-grained lower bainite, fine-grained lath martensite, or mixtures thereof. The composition consists of (in mass %) about 0.03% to about 0.10% C, about 1.6% to about 2. 1% Mn, about 0.01% to about 0.10% Nb, about 0.01% to about 0.10% V, about 0.2% to about 0.5% Mo, about 0.005% to about 0.03% Ti, about 0.0005 % to about 0.0020% B. The boron-containing steel is further comprising at least one additive selected from the group consisting of (i) 0 wt % to about 0.6 wt % Si, (ii) 0 wt % to about 1.0 wt % Cu, (iii) 0 wt % to about 1.0 wt % Ni, (iv) 0 wt % to about 1.0 wt % Cr, (v) 0 wt % to about 0.006 wt % Ca, (vi) 0 wt % to about 0.06 wt % Al, (vii) 0 wt % to about 0.02 wt % REM, and (viii) 0 wt % to about 0.006 wt % Mg. Again, the processing is limited to hot rolling alone, followed by quenching to a quench stop temperature and subsequent air cooling. The cost of this analysis is also quite high in view of the large Mo and V contents that are applied.

Aims of the Invention

It is the aim of the present invention to provide an ultra high strength steel (UHSS) product, produced by cold rolling and annealing and possibly followed by electrolytic zinc coating or hot dip galvanising, in order to have the UHSS product available at low thicknesses which are not possible or very difficult to produce by hot rolling.

It is a further aim to provide an ultra high strength steel product, produced by hot rolling and pickling, which can be hot dip galvanised, keeping still ultra high strength properties in combination with a good corrosion protection.

SUMMARY OF THE INVENTION

The present invention is related to an ultra high strength steel composition intended to be used in a process comprising at least a hot rolling step, said composition being characterised by the following contents C: between 1000 ppm and 2500 ppm
Mn: between 12000 ppm and 20000 ppm
Si: between 1500 ppm and 3000 ppm
P: between 100 ppm and 500 ppm
S: maximum 50 ppm
N: maximum 100 ppm
Al: maximum 1000 ppm
B: between 10 ppm and 35 ppm
Tifactor=Ti−3.42N+10: between 0 ppm and 400 ppm
Nb: between 200 ppm and 800 ppm
Cr: between 2500 ppm and 7500 ppm
Mo: between 1000 ppm and 2500 ppm
Ca: between 0 and 50 ppm the remainder being substantially iron and incidental impurities.

Three specific embodiments are related to the same composition, but having three different sub-ranges for carbon: respectively 1200-2500 ppm, 1200-1700 ppm and 1500-1700 ppm.

Likewise, two specific embodiments are related to the same composition, but having the following sub-ranges for phosphor: respectively 200-400 ppm and 250-350 ppm.

Finally, two more specific embodiments are related to same composition, but having the following sub-ranges for Nb: respectively 250-550 ppm and 450-550 ppm.

According to a further embodiment, the invention is related to an ultra high strength steel composition intended to be used in a process comprising at least a hot rolling step, said composition being characterised by the following contents:

C: between 1000 ppm and 2500 ppm
Mn: between 12000 ppm and 20000 ppm
Si: between 1500 ppm and 3000 ppm
P: between 500 ppm and 600 ppm
S: maximum 50 ppm
N: maximum 100 ppm
Al: maximum 1000 ppm
B: between 10 ppm and 35 ppm
Tifactor=Ti−3.42N+10: between 0 ppm and 400 ppm
Nb: between 200 ppm and 800 ppm
Cr: between 2500 ppm and 7500 ppm
Mo: between 1000 ppm and 2500 ppm
Ca: between 0 and 50 ppm the remainder being substantially iron and incidental impurities.

The invention is also related to said composition, having between 500 ppm and 600 ppm phosphor and wherein the range for carbon is between 1200 ppm and 2500 ppm. In a further embodiment of the same composition, the range for carbon is between 1200 ppm and 1700 ppm. In a further embodiment, the range for carbon is between 1500 ppm and 1700 ppm.

Likewise, in the composition having 500-600 ppm phosphor, the range of Nb may be between 250 ppm and 550 ppm according to one embodiment, or between 450 and 550 ppm, according to another embodiment.

The invention is equally related to a process for manufacturing an ultra high strength steel product, comprising the steps of:

preparing a steel slab having a composition according to the invention,
hot rolling said slab, wherein the finishing rolling temperature is higher than the Ar3 temperature, to form a hot-rolled substrate,
cooling step to the coiling temperature,
coiling said substrate at a coiling temperature CT comprised between 450° C. and 750° C.,
pickling said substrate to remove the oxides.

According to one embodiment, said coiling temperature is higher than the bainite start temperature Bs.

The process of the invention may further comprise the step of re-heating said slab to at least 1000° C. before said hot rolling step.

According to a first embodiment of the invention, the process further comprises the steps of soaking said substrate at a temperature between 480° C. and 700° C., during less than 80 s,
cooling said substrate down to the temperature of a zinc bath at a cooling rate higher than 2° C./s,
hot dip galvanising said substrate in said zinc bath,
final cooling to room temp at a cooling rate higher than 2° C./s.

A hot rolled substrate according to the invention may also be subjected to a skinpass reduction of maximum 2%. In stead of a hot dip galvanizing, the hot rolled substrate may be subjected to a step of electrolytic zinc coating.

According to a second embodiment, the process further comprises the steps of:

cold rolling said substrate to obtain a reduction of thickness,
annealing said substrate up to a maximum soaking temperature comprised between 720° C. and 860° C.,
cooling said substrate with a cooling rate higher than 2° C./s down to a temperature of maximum 200° C.,
final cooling to room temperature at a cooling rate higher than 2° C./s Alternatively, in said second embodiment, said step of annealing may be followed by:

cooling said substrate with a cooling rate higher than 2° C./s down to a temperature of maximum 460° C.,
holding said substrate at said temperature of maximum 460° C. for a time less than 250 s,
final cooling to room temperature at a cooling rate higher than 2° C./s.

According to a third embodiment, the process further comprises the steps of:

cold rolling said substrate to obtain a reduction of thickness,
annealing said substrate up to a maximum soaking temperature comprised between 720° C. and 860° C.,
cooling said substrate with a cooling rate higher than 2° C./s to the temperature of a zinc bath,
hot dip galvanising said substrate in said zinc bath,
final cooling to room temperature at a cooling rate higher than 2° C./s.

A cold rolled substrate according to the invention may also be subjected to a skinpass reduction of maximum 2%. In stead of a hot dip galvanizing, the cold rolled substrate may be subjected to a step of electrolytic zinc coating.

The invention is equally related to a steel product produced according to the process of the invention, comprising at least a bainitic phase and/or a martensitic phase, and wherein the phase distribution is such that the sum of bainitic and martensitic phases is higher than 35%. In a preferred embodiment, said steel product has a tensile strength higher than 1000 MPa.

The invention is further related to a steel product produced according to the process of the invention comprising a cold rolling step, said product having a yield strength between 350 MPa and 1150 MPa, a tensile strength between 800 MPa and 1600 MPa, an elongation A80 between 5% and 17%. Said product is preferably a steel sheet of which the thickness may lie between 0.3 mm and 2.0 mm.

The invention is equally related to a steel product produced according to the process of the invention including a hot rolling step but not a cold rolling step, said product having a yield strength between 550 MPa and 950 MPa, a tensile strength between 800 MPa and 1200 MPa, an elongation A80 between 5% and 17%.

A steel product according to the invention may have a bake hardening BH2 higher than 60 MPa in both longitudinal and transversal directions.

DETAILED DESCRIPTION OF THE PREFERRED EMBODIMENTS

Figure 1:
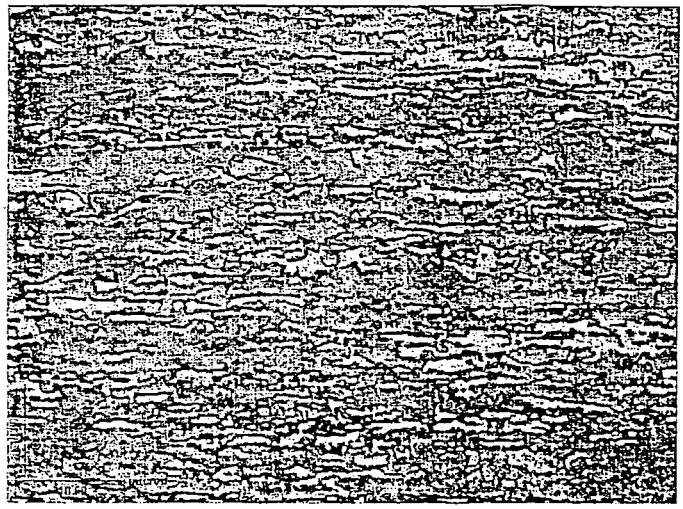
FIG. 1 is describing the overall microstructure of a hot rolled product according to the present invention.

According to the presents invention an ultra high strength steel product is proposed, having the following composition. Application of the broadest ranges which are indicated, will be able, in combination with the right process parameters, to result in products having a desired multi-phase microstructure, good weldability as well as excellent mechanical properties, for example a tensile strength between 800 and 1600 MPa. The preferred ranges are related to more narrow ranges of mechanical properties, for example a guaranteed minimum tensile strength of 1000 MPa, or to more stringent requirements on weldability (maximum of C-range, see next paragraph).

C: between 1000 ppm and 2500 ppm. A first preferred sub-range is 1200-2750 ppm. A second preferred sub-range is 1200-1700 ppm. A third preferred sub-range is 1500-1700 ppm. The minimum carbon content is needed in order to ensure the strength level as carbon is the most important element for the hardenability. The maximum of the claimed range is related to weldability. The effect of C on mechanical properties is illustrated by exemplary compositions A, B and C (tables 1,13,14,15).

Mn: between 12000 ppm and 20000 ppm, preferably between 15000-17000 ppm. Mn is added to increase the hardenability at low cost and is limited to the claimed maximum to ensure coatability. It also increases the strength through solid solution strengthening.

Si: between 1500 ppm and 3000 ppm, preferably between 2500-3000 ppm. Si is known to increase the rate of redistribution of carbon in austenite and it retards austenite decomposition. It suppresses carbide formation and contributes to the overall strength. The maximum of the claimed range is related to the ability to perform hot dip galvanising, more particularly in terms of wettability, coating adhesion and surface appearance.

P: according to a first embodiment of the invention, the P content is between 100 ppm and 500 ppm. A first preferred sub-range is 200-400 ppm. A second preferred sub-range is 250-350 ppm. P contributes to the overall strength by solid solution strengthening and, like Si, it can also stabilise the austenite phase before final transformation occurs.

According to a second embodiment of the invention, the P content is between 500 and 600 ppm, in combination with ranges of the invention for the other alloying elements mentioned in this description. Exemplary compositions D and E (tables 16/17) illustrate the effect of P on the mechanical properties.

S: lower than 50 ppm. The S-content has to be limited because a too high inclusion level can deteriorate the formability;

Ca: between 0 and 50 ppm: the steel has to be Ca-treated in order to have the remaining sulphur bound in spherical CaS instead of MnS which has a detrimental effect on deformability properties after rolling (elongated MnS easily leads to crack initiation).

N lower than 100 ppm

Al: between 0 and 1000 ppm. Al is only added for desoxidation purposes before Ti and Ca are added so that these elements are not lost in oxides and can fulfil their intended role.

B: between 10 and 35 ppm, preferably between 20 and 30 ppm. Boron is an important element for the hardenability in order to be able to reach tensile strengths higher than 1000 MPa. Boron shifts very effectively the ferrite region towards longer times in the temperature-time-transformation diagram.

Tifactor=Ti−3.42N+10: between 0 and 400 ppm, preferably between 50 and 200 ppm. Ti is added to bind all N so that B can fully fulfil its role. Otherwise part of the B can be bound into BN with a loss in hardenability as a consequence. The maximum Ti-content is limited in order to limit the amount of Ti-C containing precipitates which add to the strength level but decrease formability too much.

Nb: between 2000 ppm and 800 ppm. A first preferred sub-range is 250-550 ppm. A second preferred sub-range is 450-550 ppm. Nb retards the recrystallisation of austenite and limits grain growth through fine carbide precipitation. In combination with B it prevents the growth of large $Fe_{23}(CB)_6$ precipitates at the austenite grain boundaries so that B is kept free to perform its hardening influence. Finer grains also contribute to the strength increase while keeping good ductility properties up to a certain level. Ferrite nucleation is enhanced due to cumulated strain in the austenite under the temperature of non-recrystallisatlon of the austenite. An increase of Nb above 550 ppm was found not to, increase the strength level anymore. Lower Nb contents bring the advantage of lower rolling forces, especially in the hot rolling mill, which increases the dimensional window one steelmaker can guarantee.

Cr: between 2500 ppm and 7500 ppm, preferably between 2500 and 5000 ppm for hot dip galvanisability reasons as Cr>0.5% is known to impair the wettability through Cr-oxide formation at the surface. Cr decreases the bainite start temperature and together with B, Mo and Mn allows to isolate the bainite region.

Mo: between 1000 ppm and 2500 ppm, preferably between 1600 and 2000 ppm. Mo contributes to the strength, decreases the bainite start temperature and decreases the critical cooling rates for bainite formation.

The balance of the composition is being met by substantially iron and incidental impurities.

The combination of B, Mo and Cr (and Mn) allows to isolate the bainite region which for the hot rolled product allows to obtain easily a microstructure with bainite as principal constituent. In order to limit S at maximum 50 ppm to lower the amount of inclusions, and in order to prevent MnS formation, the steel is Ca-treated. Remaining Ca and S can then be found in spherical CaS which are much less detrimental for deformability properties than MnS. Furthermore, Si is limited compared to existing steels, which ensures galvanisability for hot-rolled as well as cold rolled products having this composition.

The present invention is equally related to the process for producing said steel product. This process comprises the steps of:

- preparing a steel slab having a composition according to the invention, such as defined above,
- if necessary, reheating said slab to a temperature higher than 1000° C., preferably above 1200° C. in order to dissolve the niobium carbides so that Nb can fully play its role. Reheating of the slab can be unnecessary if the casting is followed in line by the hot rolling facilities.
- hot rolling the slab, wherein the finishing rolling temperature FT at the last stand of hot rolling is higher than the Ar3 temperature. Preferably lower FT's are used (but still above Ar3, e.g. 750° C.) if the A80 elongation (tensile test measurement according to EN10002-1 standard) of the hot rolled coiled product has to be increased without altering the tensile strength. Compared to an FT of 850° C. a 10% relative increase of A80 can be obtained with an FT of 750° C., but at the expense of higher finishing rolling forces.
- cooling to coiling temperature CT, preferably by continuous cooling to the CT, typically at 40-50° C./s. Stepwise cooling may be used as well.
- hot rolling mill coiling of said substrate at a coiling temperature CT comprised between 450° C. and 750° C., where the coiling temperature has an important influence on the mechanical properties of both the hot rolled product as well as the product after cold rolling and annealing (see examples). In all cases the preferable minimum coiling temperature is above 550° C. and higher than the bainite start temperature, so that the bainite transformation occurs completely in the coil. Bainite start temperature Bs is <550° C. for the composition of the example, for cooling speeds after the finishing mill higher than 6° C./min. A coiling temperature just above the bainite start temperature (e.g. CT=570-600° C.) does not pose any processing problems in the hot rolling mill. Coiling at CT higher than Bs ensures that the material transforms in the coil and not on the runout table. The isolation of the bainite domain thus allows to increase the process robustness and thus guarantees a higher stability of the mechanical properties with regard to changes in cooling conditions.
- pickling the substrate to remove the oxides.

According to a first embodiment of the invention, these steps are followed by

- soaking the substrate at a temperature between 480° C. and 700° C., preferably at a temperature below or equal to 650° C. and during less than 80 s,
- cooling down to the temperature of a zinc bath at a cooling rate higher than 2° C./s,
- hot dip galvanising of the hot rolled substrate,
- cooling down to room temp at a cooling rate higher than 2° C./s,
- possibly, a skinpass of maximum 2%.

This hot dip galvanising of the hot rolled product may be done if the thickness is high enough to produce the material by hot rolling alone, providing a hot dip galvanised hot rolled end product.

According to a second embodiment, the pickling step is followed by:

- cold rolling to obtain a reduction of thickness, for example 50%,
- annealing up to a maximum soaking temperature comprised between 720° C. and 860° C.,
- cooling with a cooling rate higher than 2° C./s down to a temperature of maximum 200° C.,
- final cooling to room temperature at a cooling rate higher than 2° C./s. Alternatively, the cooling down after the annealing step may be performed at a cooling rate higher than 2° C./s to a so called averaging temperature of 460° C. or less. In this case, the sheet is held at this temperature for a certain time, typically 100-200 s, before proceeding to final cooling to room temperature.

According to a third embodiment, the pickling step is followed by:

- cold rolling the substrate to obtain a reduction of thickness, for example of 50%,
- annealing up to a maximum soaking temperature comprised between 720° C. and 860° C.,
- cooling with a cooling rate higher than 2° C./s to the temperature of a zinc bath,
- hot dip galvanising,
- final cooling to room temperature.

Both the processes according to the second and third embodiment may be followed by a skinpass reduction of maximum 2%. The thickness of the steel substrates of the invention after cold rolling can be lower than 1 mm according to the initial hot rolled sheet thickness and the capability of the cold rolling mill to perform the cold rolling at a sufficiently high level. Thus, thicknesses between 0.3 and 2.0 mm are feasible. Preferably no stretch leveller/skinpass is used in order to have a lower Re/Rm ratio and higher strain hardening potential of the material.

The preferable maximum soaking temperature during the annealing step is dependent on the applied coiling temperature and aimed mechanical properties higher coiling temperatures lead to softer hot bands (increasing the maximum amount of cold rolling reduction that can be given on a particular cold rolling mill) and for the same soaking temperature and cooling rate to lower tensile strength levels (see examples). For the same coiling temperature, a higher soaking temperature will in general increase the tensile strength level with the other processing parameters kept constant.

In case the product is not hot dip galvanised, an electrolytic Zn coating can be applied to increase the corrosion protection.

The resulting product, hot rolled or cold rolled, has a multiphase structure with ferrite, martensite and different types of bainite possible, and possibly some retained austenite present at room temperature. Specific mechanical properties as a function of processing parameter values are given in the examples.

For coiling temperatures below 680° C., the hot rolled products showed in all laboratory experiments and industrial trials that were performed a continuous yielding (yielding behaviour without presence of a yield point elongation or Luders strain), and this without application of a skinpass.

Also the cold rolled product showed in all experiments and trials a continuous yielding behaviour but with a generally lower yield strength to tensile strength ratio Re/Rm than the hot rolled product (typically, the cold rolled product has an Re/Rm between 0.40 and 0.70, and the hot rolled product an Re/Rm between 0.65 and 0.85). This means that the material is characterised by a high strain hardening: the initial forces necessary to start plastic deformation can be kept quite low which facilitates the initial deformation of the material, but the material already reaches high strength levels due to the high work hardening after some % of deformation.

The final cold rolled product exhibits an ultra high strength in combination with a good ductility non-coated, electrolytically coated or hot dip galvanised materials with yield strengths Re between 350 MPa and 1150 MPa, tensile strengths Rm between 800 MPa and 1600 MPa and elongations A80 between 5% and 17% can be produced according to the specific values of the process parameters, and this for thicknesses even lower than 1.0 mm which are not possible to be reached by hot rolling alone in usual current hot rolling mills (mechanical properties measurements according to the standard EN10002-1). Cold rolled ultra high strength steels (based on other compositions) which are on the market today and which exhibit a tensile strength Rm higher than 1000 MPa in general cannot be hot dip galvanised in view of e.g. their high Si-content or show for the same strength level lower elongations than the results obtained with the product of invention.

Moreover, the product of invention exhibits a very large bake hardening potential: the $BH_0$ values exceed 30 MPa in both transverse and longitudinal directions and $BH_2$ exceeds even 100 MPa in both directions ($BH_0$ and $BH_2$ measured according to the standard SEW094). This means that for body-in-white applications during the paint baking the material will even get a higher yield strength so that the rigidity of the structure increases.

The different hot rolled microstructures as obtained after coiling as a function of the applied coiling temperatures all allow to perform cold rolling without crack introduction. This was not expected beforehand in view of the ultra high strength of the material and the lower deformability as a consequence of said ultra high strength.

Concerning process robustness, it is remarkable to note that the cooling rate after annealing can be as low as 2° C./s, whilst still providing ultra high strength properties. This means that a large variation in dimensions can be produced with quite constant properties (see examples) since the dimensions determine in most cases the maximum line speeds and the maximum cooling rates after annealing. In classical high strength or ultra high strength steels with e.g. dual phase structures consisting of ferrite and martensite, higher cooling rates have usually to be applied (typically 20-50° C./s), and the dimensional range that can be produced with one single analysis is more limited.

For larger thicknesses where cold rolling is not necessary, the hot rolled pickled product itself can be hot dip galvanised keeping still ultra high strength properties but with the advantage of better corrosion protection. Properties of the non-coated pickled hot rolled product coiled at e.g. CT=585° C. and without skinpass or stretch leveller further processed are typically Re 680-770 MPa, Rm 1060-1090 MPa and A80 11-13%, whereas after passing the hot rolled substrate through a hot dip galvanising line (with the soaking zone at e.g. 650° C.), the properties are still Re 800-830 MPa, Rm 970-980 MPa and A80 10% (mechanical properties measurements according to the standard EN10002-1).

The different drawbacks described above as to the compositions described in state of the art publications are not encountered when the composition of the present invention is applied: costs are limited due to restricted use of Mo and elimination of V, more unusual elements in classical carbon (non-stainless) steelmaking like Cu and Ni are not used, and most importantly, Si is limited in order to ensure the hot dip galvanisability. The surface appearance of the hot dip galvanised hot rolled steel of the present invention is sufficient for automotive unexposed applications whereas substrates with higher Si-contents in general lead to insufficient surface appearance for automotive applications, with moreover a higher risk on the presence of bare spots on the surface.

Concerning the weldability of the ultra high strength steels of the present invention, spot welding (e.g. evaluated according to the standard AFNOR A87-001 with cross tension tests) and laser welding results proved a satisfying weldability although it is an ultra high strength steel of which problems were a priori expected.

DETAILED DESCRIPTION OF PREFERRED EMBODIMENTS—EXAMPLES

1. Example Composition A

Table 1 shows a first example of a composition of an industrial casting of the ultra high strength steel product according to the present invention. It is to noted that in what follows, all mentioned tensile test mechanical properties are measured according to the standard EN10002-1, and bake hardening values according to the standard SEW094.

1.1 Hot Rolled Product—Composition A

The processing steps were:

Slab reheating between 1240-1300° C.

Hot rolling mill finishing between 880-900° C.

Coiling temperature between 570-600° C.

Pickling

No skinpass or stretch leveller

The mechanical properties at different positions in the coil of the resulting non-coated pickled product are summarized in Table 2. As can be seen the product is very isotropic in its mechanical properties.

Bake hardening properties after 0 and 2% uni-axial pre-strain of the resulting product are given in Table 3.

After passing the material through a hot dip galvanising line with a soaking section at a temperature between 600-650° C. where the material is kept between 40-80 s before cooling down to the zinc bath temperature and hot dip galvanising, the mechanical properties were Re 800-830 MPa, Rm 970-980 MPa and A80 9.5-10.5%, the differences with the non-coated product being due to a slight change in microstructure (carbide precipitation).

The microstructure of the hot rolled product typically consisted of the phases, described in table 4. Typical microstructures corresponding with the material as characterised in Table 4 are given in FIGS. 1 and 2.

FIG. 1 is describing the overall microstructure of the hot rolled product according to the present invention, processed at 570-600° C. coiling temperature. After etching with the so called Le Pera etchant the light coloured region in the optical micrograph is martensite as being proved after X-ray diffraction measurements.

Figure 2:
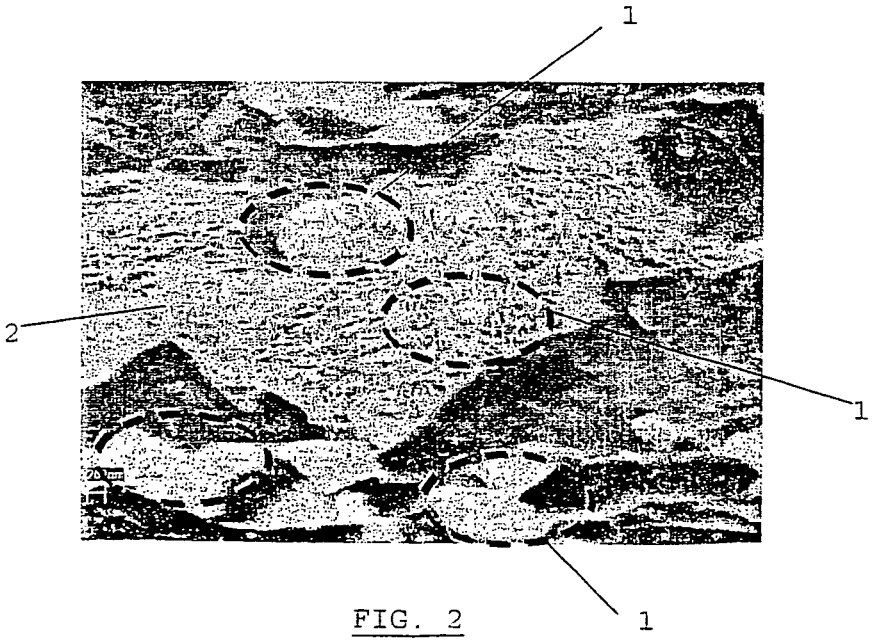
FIG. 2 is describing an example of the detailed microstructure of the product of FIG. 1.

FIG. 2 is describing an example of the detailed microstructure of the product of FIG. 1, on a scanning electron microscope photograph. The encircled zones 1 represent martensite, while the grey area 2 represents upper bainite.

A change in coiling temperature from 570-600° C. (where the mechanical properties are almost constant) to about 650° C. led to the following changes in mechanical properties: Re 600 MPa, Rm 900 MPa and A80 14-15%.

1.2 Cold Rolled Product—Composition A

Further processing of the hot rolled product, with varying the coiling temperature CT, led to the cold rolled product properties, shown in tables 5 to 12 (all thicknesses 1 mm, 50% cold rolling reduction):

The microstructures of the cold rolled products are dependent on coiling temperature, soaking temperature and cooling rate (and cold rolling reduction). Thus, the % distribution of ferrite, bainite and martensite is a function of these parameters but in general it can be noticed that for reaching tensile strengths higher than 1000 MPa, the sum of bainitic and martensitic constituents is more than 40% in an optical micrograph (500× magnification in order to be sufficiently representative).

Figure 3:
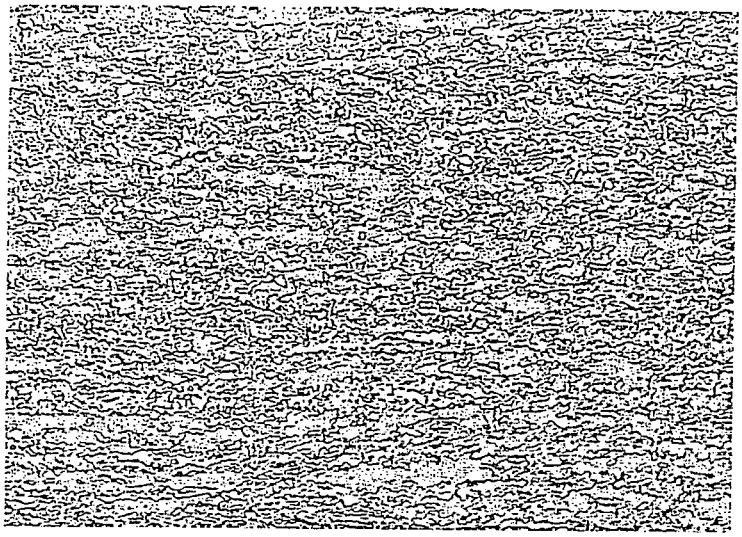
FIGS. 3 and 4 are describing the microstructure of a cold rolled and annealed product according to the present invention.
Figure 4:
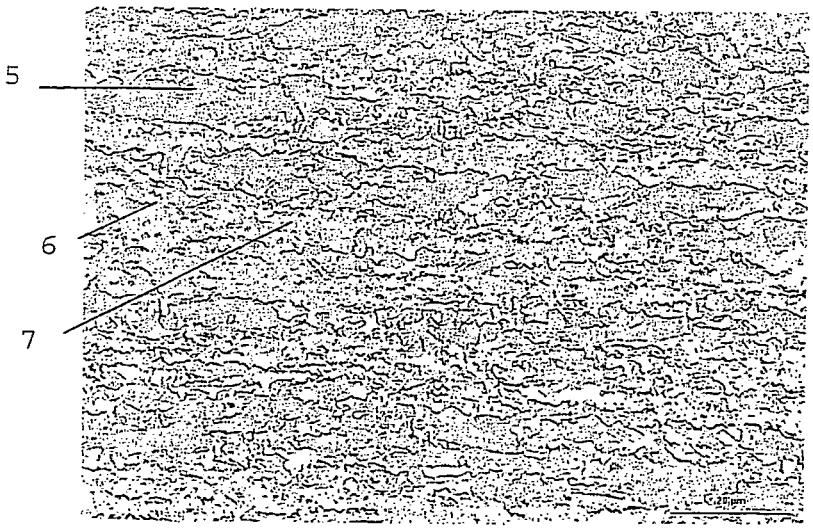

Examples of typical final cold rolled and annealed microstructures are given in FIGS. 3 and 4.

FIG. 3 is describing the microstructure (LePera etchant) at 500× magnification of a cold rolled and annealed product according to the present invention, processed at 550° C. coiling temperature, 50% cold rolling reduction, 780° C. maximum soaking temperature and a subsequent cooling rate of 2° C./s, resulting in a microstructure of 38% martensite, 9% bainite and 53% ferrite. Mechanical properties related to this structure can be found in Table 7.

FIG. 4 is describing the microstructure (LePera etchant) at 500× magnification of a cold rolled and annealed product according to the present invention, processed at 720° C. coiling temperature, 50% cold rolling reduction, 820° C. maximum soaking temperature and a subsequent cooling rate of 100° C./s, resulting in a microstructure of 48% martensite, 4% bainite and 48% ferrite. Mechanical properties related to this structure can be found in Table 6. In FIG. 4, three phases can be recognized: the darker grey areas 5 are ferrite, the lighter grey areas 6 are martensite, and the dark black areas 7 are bainite.

Considering the ultra high strength level of the materials, especially those in the range with a tensile strength higher than 1000 MPa, some combinations of processing parameters show an exceptionally good deformability even up to 14-15%.

2. Example Compositions B/C

Table 13 describes two additional castings in terms of composition, of a UHSS steel of the invention. The compositions are referred to as B and C. Slabs made of the compositions A and B underwent the following steps, yielding steel sheets according to the invention:

hot rolling, finishing temperature above Ar3
coiling at 630° C.,
pickling,
cold rolling with 50% reduction to 1.6 mm
annealing up to a maximum soaking temperature of 820° C.
cooling at 10° C./s to the zinc bath temperature,
hot dip galvanizing,
cooling to room temperature Slabs made of composition C got a similar processing but with 60% cold rolling reduction to 1.0 mm and after cooling to room temperature an extra skinpass between 0 and 1%.

The mechanical properties of the 3 hot dip galvanised steel sheets with compositions A, B and C are shown in tables 14 and 15. These examples prove the influence of the carbon-content on the mechanical properties. Lower carbon contents result in a lower carbon equivalent which is well known to be beneficial for welding.

3. Example Compositions D/E

Finally, table 16 shows the compositions, labelled D and E of two more castings according to the invention. Slabs having these compositions were subjected to the following steps:

hot rolling, finishing temp. above Ar3, to a thickness of 2 mm,
coiling at 550° C.
pickling The mechanical properties of the hot rolled product (non-coated) , measured according to EN10002-1 are shown in table 17. Apparently, the sheet having composition E (520 ppm P) has a much increased tensile strength Rm, compared to the sheet having composition D (200 ppm P), while the elongation A80% has remained unchanged. Considering the fact that the other elements, besides P, are represented by similar amounts in both castings D and E, the considerable rise in strength properties, whilst keeping a fixed elongation value, is contributed to the rise in amount of phosphor in composition E, compared to composition D.

It is known that other elements which give a strengthening effect, such as Ti, Nb or Mo, do tend to have a negative impact on the elongation. Therefore, one preferred composition of the present invention requires a minimum phosphor amount of 200 ppm, in order to guarantee the desired mechanical properties.

TABLE 1 composition A (ppm) of the ultra high strength steel product according to the present invention

| Code | C | Mn | Si | P | S | N | Al | B | Ti | Nb | Cr | Mo | Ca |
|---|---|---|---|---|---|---|---|---|---|---|---|---|---|
| A | 1650 | 15790 | 2810 | 310 | 28 | 69 | 328 | 25 | 283 | 492 | 4940 | 1980 | 26 |

TABLE 2 mechanical properties of the hot rolled, pickled, uncoated ultra high strength steel product, composition A, according to the present invention. Thickness 2.0 mm.

| | Longitudinal direction | | | | | transverse direction | | | | |
|---|---|---|---|---|---|---|---|---|---|---|
| | $R_e$/MPa | $R_m$/MPa | $A_u$/% | $A_{80}$/% | $n_{4-6}$ | $R_e$/MPa | $R_m$/MPa | $A_u$/% | $A_{80}$/% | $n_{4-6}$ |
| Position 1 | 724 | 1080 | 9 | 12 | 0.127 | 755 | 1066 | 8 | 11 | 0.122 |
| Position 2 | 688 | 1069 | 9 | 13 | 0.142 | 719 | 1069 | 9 | 12 | 0.134 |
| Position 3 | 682 | 1069 | 9 | 13 | 0.141 | 723 | 1068 | 8 | 11 | 0.128 |

TABLE 3 bake hardening properties of the hot rolled, pickled, uncoated ultra high strength steel product, composition A, according to the present invention. Thickness 2.0 mm.

| | Longitudinal | | transverse | |
|---|---|---|---|---|
| | $BH_0$/ MPa | $BH_2$/ MPa | $BH_0$/ MPa | $BH_2$/ MPa |
| Position 1 | 56 | 101 | 38 | 109 |
| Position 2 | 39 | 104 | 32 | 114 |
| Position 3 | 49 | 114 | 35 | 120 |

TABLE 4 typical phase distribution of the hot rolled ultra high strength steel product, composition A, processed at a coiling temperature between 570–600° C. The retained austenite fraction was <1%. Samples taken at different positions over the coil length.

| Phase % | Sample 1 edge | Sample 1 mid | Sample 2 edge | Sample 2 Mid |
|---|---|---|---|---|
| Ferrite | ≅8 | ≅4 | ≅8 | ≅4 |
| Bainite without cementite | 75 | 70 | 74 | 76 |
| Upper bainite with cementite | 4 | 5 | 4 | 3 |
| Martensite + retained austenite (<1%) | 13 | 21 | 14 | 17 |

TABLE 5

Tmax soaking: 780° C., Cooling rate: 100° C./s to room temperature.

| CT (° C.) | Re (MPa) | Rm (MPa) | A % | Re/Rm |
|---|---|---|---|---|
| 550 | 770 | 1486 | 7 | 0.52 |

TABLE 6

Tmax soaking: 820° C., Cooling rate: 100° C./s to room temperature.

| CT (° C.) | Re (MPa) | Rm (MPa) | A % | Re/Rm |
|---|---|---|---|---|
| 720 | 441 | 1006 | 14 | 0.44 |
| 680 | 982 | 1483 | 7 | 0.66 |
| 550 | 1137 | 1593 | 5 | 0.71 |

TABLE 7

Tmax soaking: 780° C., Cooling rate: 2° C./s to room temperature.

| CT (° C.) | Re (MPa) | Rm (MPa) | A % | Re/Rm |
|---|---|---|---|---|
| 680 | 538 | 1140 | 7 | 0.46 |
| 550 | 667 | 1338 | 7 | 0.50 |

TABLE 8

Tmax soaking: 820° C., Cooling rate: 2° C./s to room temperature.

| CT (° C.) | Re (MPa) | Rm (MPa) | A % | Re/Rm |
|---|---|---|---|---|
| 720 | 438 | 993 | 15 | 0.44 |
| 680 | 555 | 1170 | 12 | 0.49 |
| 550 | 756 | 1304 | 9 | 0.58 |

TABLE 9

Tmax soaking: 780° C., Cooling rate: 100° C./s, overaging 150 s at 400° C.

| CT (° C.) | Re (MPa) | Rm (MPa) | A % | Re/Rm |
|---|---|---|---|---|
| 720 | 400 | 853 | 14 | 0.47 |
| 680 | 511 | 1039 | 8 | 0.49 |
| 550 | 464 | 1057 | 11 | 0.44 |

TABLE 10

Tmax soaking: 820° C., Cooling rate: 100° C./s, overaging 150 s at 400° C.

| CT (° C.) | Re (MPa) | Rm (MPa) | A % | Re/Rm |
|---|---|---|---|---|
| 720 | 494 | 911 | 11 | 0.54 |
| 680 | 705 | 1103 | 8 | 0.64 |
| 550 | 831 | 1229 | 6 | 0.68 |

TABLE 11

Tmax soaking: 780° C., Cooling rate: 10° C./s, overaging 150 s from 450→380° C.

| CT (° C.) | Re (MPa) | Rm (MPa) | A % | Re/Rm |
|---|---|---|---|---|
| 720 | 398 | 917 | 15 | 0.43 |
| 680 | 472 | 1008 | 8 | 0.47 |
| 550 | 558 | 1141 | 7 | 0.49 |

TABLE 12

Tmax soaking: 820° C., Cooling rate: 10° C./s, overaging 150 s from 450→380° C.

| CT (° C.) | Re (MPa) | Rm (MPa) | A % | Re/Rm |
|---|---|---|---|---|
| 720 | 457 | 909 | 13 | 0.50 |
| 680 | 652 | 1146 | 11 | 0.57 |
| 550 | 760 | 1240 | 8 | 0.61 |

Table 5 to12: mechanical properties of the cold rolled and annealed/hot dip galvanized ultra High strength steel product, composition A, according to the present invention. Thickness 1.0mm.

TABLE 13 compositions B and C (ppm) of the ultra high strength steel product according to the present invention

| Code | C | Mn | Si | P | S | N | Al | B | Ti | Nb | Cr | Mo | Ca |
|---|---|---|---|---|---|---|---|---|---|---|---|---|---|
| B | 1500 | 15900 | 2600 | 300 | 19 | 60 | 470 | 21 | 340 | 540 | 2800 | 2000 | 18 |
| C | 1400 | 15900 | 2700 | 280 | 22 | 32 | 360 | 21 | 200 | 370 | 3200 | 1800 | 25 |

TABLE 14 mechanical properties according to EN10002-1 of cold rolled, hot dip galvanized steel sheets having compositions A and B, in longitudinal direction, thickness 1.6 mm

| Code | Re (MPa) | Rm (MPa) | A80% |
|---|---|---|---|
| A | 587 | 1156 | 12.5 |
| B | 571 | 1116 | 13 |

TABLE 15 mechanical properties according to EN10002-1 of cold rolled, hot dip galvanized steel sheets having composition C, in longitudinal direction, thickness 1.0 mm, processed with a skinpass between 0 and 1%.

| Code | Re (MPa) | Rm (MPa) | A80% |
|---|---|---|---|
| C | 510–680 | 1080–1180 | 11–14 |

TABLE 16 compositions D and E (ppm) of the ultra high strength steel product according to the present invention.

| Code | C | Mn | Si | P | S | N | Al | B | Ti | Nb | Cr | Mo | Ca |
|---|---|---|---|---|---|---|---|---|---|---|---|---|---|
| D | 1610 | 16000 | 2600 | 200 | 23 | 42 | 410 | 21 | 230 | 610 | 4300 | 2000 | 22 |
| E | 1620 | 16500 | 2800 | 520 | 40 | 42 | 450 | 22 | 240 | 480 | 4800 | 1900 | 30 |

TABLE 17 mechanical properties according to EN10002-1 of hot rolled steel sheets having compositions D and E, transverse direction, thickness 2 mm.

| Code | Re (MPa) | Rm (MPa) | A80% |
|---|---|---|---|
| D | 736 | 1061 | 10 |
| E | 781 | 1199 | 9.9 |

The invention claimed is:

1. A hot-rolled ultra high strength steel composition, said composition comprising:

Ti and N, wherein the concentration of N is between 0 and 100 parts per million (ppm mass);

Tifactor =(ppm Ti)−3.42(ppm N)+10 ppm, wherein the Tifactor is between 50 ppm and 400 ppm mass;

and further comprising:

C: between 1000 ppm and 2500 ppm mass

Mn: between 12000 ppm and 20000 ppm mass

Si: between 1500 ppm and 3000 ppm mass

P: between 280 ppm and 600 ppm mass

S: maximum 50 ppm mass

Al: maximum 1000 ppm mass

B: between 10 ppm and 35 ppm mass

Nb: between 200 ppm and 800 ppm mass

Cr: between 2500 ppm and 7500 ppm mass

Mo: between 1000 ppm and 2500 ppm mass

Ca: between 0 and 50 ppm mass the remainder being substantially iron and incidental impurities;

wherein the hot-rolled ultra high strength steel composition is in sheet form and comprises a thickness between 0.3 mm and 2.0 mm, said steel composition comprising at least a bainitic and a martensitic phase wherein the phase distribution is such that the sum of the bainitic and martensitic phases is higher than 35%, and tensile strength between 1000 MPa and 1600 MPa.

2. The composition of claim 1, Wherein the amount of carbon is between 1200 ppm and 2500 ppm.

3. The composition of claim 2, wherein the amount of carbon is between 1200 ppm and 1700 ppm.

4. The composition of claim 3, wherein the amount of carbon is between 1500 ppm and 1700 ppm.

5. The composition according to claim 1, wherein the amount of phosphorus is between 500 ppm and 600 ppm.

6. The composition according to claim 1, wherein the amount of phosphorus is between 280 ppm and 350 ppm.

7. The composition according to claim 1, wherein the amount of niobium is between 250 ppm and 550 ppm.

8. The composition according to claim 1, wherein the amount of niobium is between 450 ppm and 550 ppm.

9. The composition of claim 1, wherein the composition comprises Ti and the concentration of Ti is between 40 ppm to 732 ppm.

10. The composition of claim 1, wherein P is between 300 ppm and 600 ppm.

11. The composition of claim 1, wherein P is between 310 ppm and 600 ppm.

12. The hot-rolled composition according to claim 1, wherein said composition is futher cold-rolled and wherein the sum of bainitic and martensitic phases is higher than 40%.

13. A steel product produced in a process comprising a hot-rolling step, the product being produced from a steel composition comprising:

N, wherein the concentration of N is between 0 and 100 parts per million (ppm mass);

Tifactor =(ppm Ti)−3.42(ppm N)+10 ppm, wherein the Tifactor is between 50 ppm and 400 ppm mass;

and further comprising:

C : between 1000 ppm and 2500 ppm mass

Mn : between 12000 ppm and 20000 ppm mass

Si : between 1500 ppm and 3000 ppm mass

P : between 280 ppm and 600 ppm mass

S : maximum 50 ppm mass

Al : maximum 1000 ppm mass

B : between 10 ppm and 35 ppm mass

Nb : between 200 ppm and 800 ppm mass

Cr : between 2500 ppm and 7500 ppm mass

Mo : between 1000 ppm and 2500 ppm mass

Ca : between 0 and 50 ppm mass the remainder being substantially iron and incidental impurities;

wherein said product is a steel sheet of thickness between 0.3 mm and 2.0 mm, said product comprising at least a bainitic phase and a martensitic phase wherein the phase distribution is such that the sum of bainitic and martensitic phases is higher than 35%, and tensile strength between 1000 MPa and 1600 MPa.

14. The product according to claim 13, having a yield strength between 350 MPa and 1150 MPa and an elongation A80 between 5% and 17%.

15. The product according to claim 13, having a yield strength between 550 MPa and 950 MPa and an elongation A80 between 5% and 17%.

16. The product according to claim 13, having a bake hardening BH2 higher than 60 MPa in both longitudinal and transversal directions.

17. The product according to claim 13, wherein the composition comprises Ti and the concentration of Ti is between 40 ppm to 732 ppm.

18. The product according to claim 13, wherein P is between 300 ppm and 600 ppm.

19. The product according to claim 13, wherein P is between 310 ppm and 600 ppm.

20. The product according to claim 13, wherein said process further comprises a cold rolling step and wherein the sum of bainitic and martensitic phases is higher than 40%.

21. The product according to claim 13, wherein said process comprises the steps of:

preparing a steel slab having a composition comprising:

N, wherein the concentration of N is between 0 and 100 ppm mass;

Tifactor =(ppm Ti)−3.42(ppm N)+10 ppm, wherein the Tifactor is between 50 ppm and 400 ppm mass;

and further comprising:

C : between 1000 ppm and 2500 ppm mass

Mn : between 12000 ppm and 20000 ppm mass

Si : between 1500 ppm and 3000 ppm mass

P : between 280 ppm and 600 ppm mass

S : maximum 50 ppm mass

Al : maximum 1000 ppm mass

B : between 10 ppm and 35 ppm mass

Nb : between 200 ppm and 800 ppm mass

Cr : between 2500 ppm and 7500 ppm mass

Mo : between 1000 ppm and 2500 ppm mass

Ca : between 0 and 50 ppm mass the remainder being substantially iron and incidental impurities;

hot rolling said slab, wherein the finishing roiling temperature is higher than the Ar3 temperature, to form a hot-rolled substrate;

cooling the hot rolled substrate to a coiling temperature CT;

coiling said substrate at a coiling temperature CT comprised between 450° C. and 750° C.; and pickling said substrate to remove oxides.

22. The product according to claim 21, wherein said coiling temperature CT is higher than a bainite start temperature Bs.

23. The product according to claim 21, wherein the process further comprises the step of re-heating said slab to at least 1000° C. before said hot rolling step.

24. The product according to claim 21, wherein the process further comprises the steps of:

soaking said substrate at a temperature between 480° C. and 700° C., during less than 80 s, cooling said substrate down to the temperature of a zinc bath at a cooling rate higher than 2° C./s, hot dip galvanising said substrate in said zinc bath, and final cooling said substrate to room temperature at a cooling rate higher than 2° C./s.

25. The product according to claim 21, wherein the process is followed by a step of skinpass reduction of said substrate, with a maximum reduction of 2%.

26. The product according to claim 21, wherein the process is followed by a step of electrolytic zinc coating.

27. The product according to claim 21, wherein the process further comprises the steps of:

cold rolling said substrate to obtain a reduction of thickness, annealing said substrate up to a maximum soaking temperature comprised between 720° C. and 860° C., cooling said substrate with a cooling rate higher than 2° C./s down to a temperature of maximum 460° C., holding said substrate said temperature of maximum 460° C. for a time less than 250s, and final cooling said substrate to room temperature at a cooling rate higher than 2° C./s.

28. The product according to claim 21, wherein the process further comprises the steps of:

cold rolling said substrate to obtain a reduction of thickness, annealing said substrate up to a maximum soaking temperature comprised between 720° C. and 860° C., cooling said substrate with a cooling rate higher than 2° C./s to the temperature of a zinc bath, hot dip galvanising said substrate in said zinc bath, and final cooling said substrate to room temperature at a cooling rate higher than 2° C./s.

29. The product according to claim 21, wherein the process further comprises the steps of:

cold rolling said substrate to obtain a reduction of thickness, annealing said substrate up to a maximum soaking temperature comprised between 720° C. and 860° C., cooling said substrate with a cooling rate higher than 2° C./s down. to a temperature of maximum 200° C., and final cooling said substrate to room temperature at a cooling rate higher than 2° C./s.

30. The product according to claim 29, wherein the process is followed by a step of skinpass reduction of said substrate, with a maximum reduction of 2%.

31. The product according to claim 29, wherein the process is followed by a step of electrolytic zinc coating.

* * * * *